US007580655B2

(12) United States Patent
Nukada et al.

(10) Patent No.: US 7,580,655 B2
(45) Date of Patent: Aug. 25, 2009

(54) CHARGING ROLLER, ELECTROPHOTOGRAPHIC PROCESS CARTRIDGE, AND IMAGE FORMING APPARATUS

(75) Inventors: Hidemi Nukada, Kanagawa (JP); Shigeto Hashiba, Kanagawa (JP); Takahiro Suzuki, Kanagawa (JP); Koji Bando, Kanagawa (JP); Makoto Takemoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 11/798,745

(22) Filed: May 16, 2007

(65) Prior Publication Data

US 2008/0107451 A1 May 8, 2008

(30) Foreign Application Priority Data

Nov. 2, 2006 (JP) ..... 2006-298981

(51) Int. Cl.
*G03G 15/02* (2006.01)

(52) U.S. Cl. ..... 399/176

(58) Field of Classification Search ..... 399/168, 399/174, 176

See application file for complete search history.

(56) References Cited

U.S. PATENT DOCUMENTS 6,317,574 B1 * 11/2001 Shinohara et al. ..... 399/176
6,620,476 B2 * 9/2003 Tarnawskyj et al. ..... 428/36.8

FOREIGN PATENT DOCUMENTS

| | | |
|---|---|---|
| JP | A-47-30330 | 11/1972 |
| JP | A-08-176293 | 7/1996 |
| JP | A-08-208820 | 8/1996 |
| JP | B2-3026290 | 1/2000 |
| JP | A-2001-350351 | 12/2001 |

* cited by examiner

*Primary Examiner*—Hoang Ngo
(74) *Attorney, Agent, or Firm*—Oliff & Berridge, PLC

(57) ABSTRACT

A charging roller including: a support; an elastic layer provided on the outer peripheral surface of the support, and having a ground-finished outer peripheral surface; and a surface layer formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, and after storage for 48 hours in an environment having a temperature of 28° C. and a humidity of 85% RH, being about 2% to about 8% by weight, being about 2% to about 8% by weight.

20 Claims, 1 Drawing Sheet

CHARGING ROLLER, ELECTROPHOTOGRAPHIC PROCESS CARTRIDGE, AND IMAGE FORMING APPARATUS

CROSS-REFERENCE TO RELATED APPLICATION

This application claims priority under 35USC119 from Japanese Patent Application No. 2006-298981.

BACKGROUND

1. Technical Field

The present invention relates to a charging roller, an electrophotographic process cartridge, and an image forming apparatus.

2. Related Art

Image forming apparatuses utilizing an electrographic system allows high-speed and high-quality printing, thus have been used in copying machines, laser beam printers, and other machines. In an image forming apparatus utilizing an electrographic system, a uniform electric charge is formed on the surface of an electrophotographic photoreceptor, and an electrostatic latent image is formed by an LED, laser, or the like, thereafter the electrostatic latent image is developed with charged toner into a toner image. Further, the toner image is transferred to a recording medium, such as paper, via an intermediate transfer medium or directly using electrostatic, and thereby a desired image is formed.

As described above, an image forming apparatus utilizing an electrographic system involves a charging process for forming a uniform electric charge on the surface of an electrophotographic photoreceptor, wherein the electrophotographic photoreceptor is charged by a non-contact or contact charging method. Commonly a non-contact charging method uses a corotron or scorotron, and a common contact charging method uses a roll, brush, sheet, or the like. Since in contact charging methods generally, the applied electric current is smaller, they thus generate significantly smaller quantities of ozone than non-contact charging methods.

In printers used at offices and homes, consumable parts which require replacement, such as electrophotographic photoreceptors and toner, may be of cartridge type for easy replacement. These easily replaceable cartridges are required to have a longer life in order to reduce the frequency of replacement, reflecting recent environment issues. For extending the life of a cartridge containing an electrophotographic photoreceptor, it is necessary to extend the life of the electrophotographic photoreceptor and units incorporated in the electrophotographic photoreceptor, such as a unit for charging the electrophotographic photoreceptor, an image input unit for forming an electrostatic latent image on the electrophotographic photoreceptor, a development unit for developing the electrostatic latent image with a developer into a toner image, a transfer unit for transferring the toner image to a receiving medium, and a cleaning unit for removing the residual developer remaining on the electrophotographic photoreceptor after transfer.

When the electrophotographic photoreceptor is charged with a charging unit using a direct current alone, abrasion of the electrophotographic photoreceptor can be suppressed and the electrophotographic photoreceptor can be used for a longer term. The charging unit often has an intermediate layer and a migration preventing layer provided on the surface of a resistive layer, for preventing bleeding and blooming. The resistive layer is often ground into a precise shape, in order to ensure uniform contact between the charging unit and electrophotographic photoreceptor. The grinding treatment is usually conducted with a grinding stone.

SUMMARY

The present invention has been made in view of the above circumstances and provides charging roller, electrophotographic process cartridge, and image forming apparatus.

A first aspect of the present invention provides a charging roller including:

a support;

an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

A second aspect of the present invention provides an electrophotographic process cartridge including:

an electrophotographic photoreceptor;

a charging unit which is disposed in contact with the electrophotographic photoreceptor and charges the electrophotographic photoreceptor to a predetermined electric potential; and at least one selected from the group consisting of an electrostatic latent image forming unit that forms an electrostatic latent image on the charged surface of the electrophotographic photoreceptor, a development unit which transfers toner to the electrostatic latent image formed on the electrophotographic photoreceptor to develop the image into a toner image, and a transfer unit which transfers the toiler image to a receiving member;

the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

A third aspect of the present invention provides an image forming apparatus including:

an electrophotographic photoreceptor;

a charging unit that is disposed in contact with the electrophotographic photoreceptor and charges the electrophotographic photoreceptor to a predetermined electric potential;

an electrostatic latent image forming unit that forms an electrostatic latent image on the charged surface of the electrophotographic photoreceptor;

a development unit that transfers toner to the electrostatic latent image formed on the electrophotographic photoreceptor to develop the image into a toner image; and a transfer unit that transfers the toner image to a receiving member, the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

BRIEF DESCRIPTION OF THE DRAWINGS

Exemplary embodiments of the present invention will be described in detail based on the following FIGURES, wherein.

DETAILED DESCRIPTION

<Charging Roller>

Figure 1:
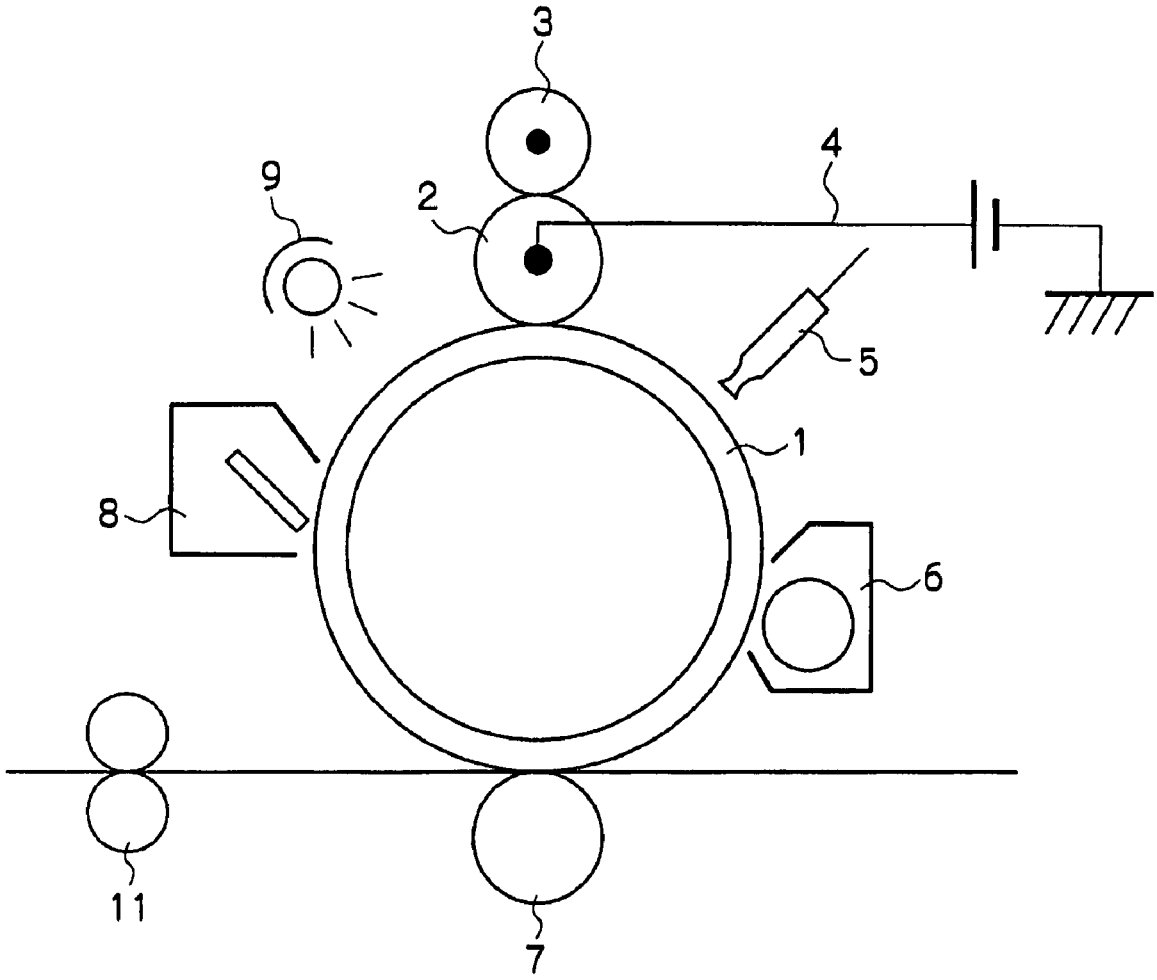
FIG. 1 is a schematic view of an image forming apparatus according to an embodiment of the present invention.

The charging roller according to an embodiment of the invention includes a support, an elastic layer which is formed on the circumference surface of the support and has a grounding treatment circumference surface, and a surface layer which is formed to cover the circumference surface of the elastic layer and has a thickness of about 2 μm to about 10 μm from the circumference surface of the elastic layer, wherein the charging roller has a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight. The charging roller may further includes an adhesive layer for bonding the support to the elastic layer, an intermediate layer, a resistance adjusting layer. The elastic layer may function as a resistance adjusting layer.

The charging roller according to an embodiment of the invention having the above-described structure offers good electrical properties and highly stable image quality even after long-term repeated use. This is because the retention of the above-described moisture content of about 2% to about 8% by weight allows the stable maintenance of resistivity against ambient environmental changes and long-term use.

Further, in the charging roller according to an embodiment of the invention, it is preferable that a direct current alone be applied to the below-described electrophotographic photoreceptor for reducing the wear and extending the life of the electrophotographic photoreceptor.

The support of the charging roller according to an embodiment of the invention is composed of a conductive material having a volume resistivity of about $10^4$ Ωcm or less) such as iron, copper, brass, stainless steel, aluminum, nickel, or a resin molding containing conductive particles or the like dispersed therein.

The adhesive layer which may be included in the charging roller according to an embodiment of the invention may be composed of any known material as long as it is capable of bonding a metal material with a rubber material, and preferably is conductive or semiconductive. Examples of the material of the adhesive layer in the invention include resins containing an electronic conductive agent and conductive resins.

The elastic layer of the charging roller according to an embodiment of the invention is composed of a conductive or semiconductive material having a volume resistivity of about $10^{13}$ Ωcm or less, such as a rubber material containing a conductive agent. Examples of the rubber material include isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-acryl glycidyl ether copolymer rubber, ethylene-propylene-diene copolymer rubber, acrylonitrile-butadiene copolymer rubber, and natural rubber. These rubbers may be used in combination of two or more. Among them, silicone rubber, ethylene propylene rubber, epichlorohydrin-ethylene oxide copolymer rubber, epichlorohydrin-ethylene oxide-acryl glycidyl ether copolymer rubber, and combinations thereof are preferable. These rubber materials may be foamed or non-foamed.

The conductive agent used in the elastic layer may be a electronic conductive substance or ion conductive substance.

Examples of the electronic conductive substance include: carbon black such as Ketjen Black and acetylene black; metals such as pyrolytic carbon, graphite, zinc, aluminum, copper, iron, nickel, chromium, and titanium; and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO.

The ion conductive substance may be a known one such as a quaternary ammonium salt or perchlorate of an alkali metal or alkaline earth metal, These conductive agents may be used alone or in combination of two or more.

The content of the conductive agent may be freely determined in the range that provides desired properties. When the conductive agent is an electronic conductive agent, the content thereof is preferably in the range of about 1 to about 90 parts by weight with respect to 100 parts by weight of the rubber material, and when an ion conductive agent, the content thereof is preferably in the range of about 0.01 to about 10 parts by weight with respect to 100 parts by weight of the rubber material.

The volume resistivity of the elastic layer is preferably about $10^3$ to about $10^{12}$ Ωcm, more preferably about $10^4$ to about $10^9$ Ωcm, and further preferably about $10^5$ to about $10^8$ Ωcm. If the volume resistivity of the elastic layer is less than about $10^3$ Ωcm, the layer tends to cause dielectric breakdown to produce image quality defects, and if exceeding about $10^{12}$ Ωcm, the layer has a so low charging capacity that it may produce image quality defects.

In the invention, the volume resistivity is a volume resistivity at a temperature of 20° C. The volume resistivity of the elastic layer was determined as follows: a sheet sample of the elastic layer was prepared, an electrode (R12702A/B resistivity chamber, manufactured by Advantest Corporation) was attached to each surface of the sheet sample, a ring-shaped ground electrode was further attached to one surface of the sheet sample electrode in coaxial alignment with the above-described electrode, and a high resistance meter (R8340A digital ultra-high resistance/micro current meter, manufactured by Advantest Corporation) was connected to the electrode. A voltage adjusted to give an electric field (applied voltage/sheet sample thickness) of 1000 V/cm to the sheet sample was applied to the electrode, and the current value after charging for 30 seconds was measured and used for the calculation of the volume resistivity (Ω·cm) by the following formula (1).

Volume resistivity (Ω·cm)=19.63×applied voltage (V)/current value (A)×sheet sample thickness (cm) Formula (1)

The elastic layer of the charging roller according to an embodiment of the invention has a ground external surface. Through the grinding treatment on the external surface of the elastic layer, the charging roller according to an embodiment of the invention has a precise shape for ensuring uniform contact with an electrophotographic photoreceptor along the length of the roller in a below-described process cartridge or image forming apparatus. The shape after the grinding treatment is not particularly limited if it provides desired properties, and may be determined as appropriate according to the diameter and length of the electrophotographic photoreceptor, the diameter and length of the charging roller, and the diameter and material of the charging roller support.

Any tool may be used for grinding treatment the elastic layer, and a grinding wheel is most preferably used.

Further, the surface roughness Rz of the elastic layer after subjected to the grinding treatment is preferably about 20 μm or less. If the surface roughness Rz of the elastic layer is exceeding about 20 μm, toner, dust, or the like may accumulate in the recess of the charging roller to cause image defects. The surface roughness Rz of the elastic layer is more preferably about 10 μm or less, and further preferably about 8 μm or less. The surface roughness Rz of the elastic layer was measured with SURFCOM 1400A (manufactured by Tokyo Seimitu Co., Ltd.), and calculated based on JIS B 0601.

The surface layer of the charging roller according to an embodiment of the invention is formed to prevent the contamination by toner, dust, or the like, and the material of the layer may be any known resin, rubber, or the like in the range that provides desired properties. Preferable examples thereof include polyolefin resins such as acrylic resin, fluorine modified acrylic resin, silicone modified acrylic resin, cellulose resin, polyamide resin, polyurethane resin, polycarbonate resin, polyester resin, polyimide resin, epoxy resin, silicone resin, polyvinyl alcohol resin, cellulose, polyvinyl acetal resin, ethylene tetrafluoroethylene resin, melamine resin, polyethylene resin, polyvinyl resin, polyarylate resin, polythiophene resin, PFA (perfluoroalkyl vinyl ether copolymer), FEP (tetrafluoride ethylene-hexafluoride propylene copolymer), and PET (polyethylene terephthalate), styrene butadiene resin, and fluorine rubber. Among them, polyvinylidene fluoride resin, tetrafluoride ethylene resin, and polyamide resin are preferable from the viewpoint of preventing contamination. These resins may be used alone or in combination of two or more.

The volume resistivity (20° C.) of the surface layer is preferably about $10^3$ to about $10^{12}$ Ωcm, more preferably about $10^4$ to about $10^9$ Ωcm, and further preferably about $10^5$ to about $10^8$ Ωcm. If the volume resistivity of the surface layer is less than about $10^3$ Ωcm, the layer tends to cause dielectric breakdown to produce image quality defects, and if exceeding about $10^{12}$ Ωcm, the layer has poor charging capacity which may result in image quality defects.

The volume resistivity of the surface layer was determined as follows: a sheet sample of the surface layer was prepared, an electrode (R12702A/B resistivity chamber, manufactured by Advantest Corporation) was attached to each surface of the sheet sample, a ring-shaped ground electrode was further attached to one surface of the sheet sample electrode in coaxial alignment with the above-described electrode, and a high resistance meter (R8340A digital ultra-high resistance/micro current meter, manufactured by Advantest Corporation) was connected to the electrode. A voltage adjusted to give an electric field (applied voltage/composition sheet thickness) of 1000 V/cm to the sheet sample was applied to the electrode, and the current value after charging for 30 seconds was measured and used for the calculation of the volume resistivity (Ω·cm) by the following formula (1).

Volume resistivity (Ω·cm)=19.63×applied voltage (V)/current value (A)×composition sheet thickness (cm) Formula (1)

The surface layer may contain a conductive agent for adjusting the volume resistivity of the layer. Examples of the conductive agent include the conductive agents exemplified for the elastic layer, such as carbon black, metal, and metal oxide.

The surface layer may further contain, if necessary, an antioxidant such as hindered phenol and hindered amine, a filler such as clay and kaolin, and a lubricant such as silicone oil.

The above-described intermediate layer is composed of a conductive or semiconductive polymer material having a volume resistivity of about $10^{13}$ Ωcm or less. Examples of the polymer material include rubber materials such as SBR (styrene butadiene rubber), BR (polybutadiene rubber), high styrene rubber (Hi Styrene resin masterbatch), IR (isoprene rubber), IIR (butyl rubber), halogenated butyl rubber, NBR (nitrile butadiene rubber), hydrogenated NBR (H—NBR), EPDM (ethylene-propylene-diene ternary copolymer rubber), EPM (ethylene propylene rubber), NBR/EPDM rubber, CR (chloroprene rubber), ACM (acryl rubber), CO (hydrin rubber), ECO (epichlorohydrin rubber), chlorinated polyethylene, VAMAC (ethylene-acryl rubber), VMQ (silicone rubber), AU (urethane rubber), FKM (fluoride rubber), NR (natural rubber), and CSM (chlorosulphonated polyethylene rubber); and resin materials such as PVC (polyvinyl chloride), polyethylene, polypropylene, polystyrene, polyester, polyurethane, polyamide, polyimide, nylon, ethylene-vinyl acetate copolymer, ethylene-ethyl acrylate copolymer, ethylene-methyl acrylate copolymer, styrene-butadiene copolymer, polyarylate, polycarbonate, Teflon (registered trademark), and silicone. The resin is freely selected from mixtures, copolymers, and modified derivatives.

The above-described resistance adjusting layer is formed for adjusting the charging roller to a predetermined resistance value, and is composed of a thin resin film containing the above-described conductive particles dispersed therein. The resin to be used is not particularly limited, and preferable examples thereof include polyurethane, polyamide, polyester, and acrylic resin. As the conductive agent, those used for the elastic layer are preferably used.

Examples of the method to form the above-described elastic layer, surface layer, and if necessary, adhesive layer, intermediate layer, and resistance adjusting layer include a blade coating method, Meyer bar coating method, spray coating method, dip coating method, bead coating method, air knife coating method, and curtain coating method.

The charging roller according to an embodiment of the invention has projections and depressions on the surface of the elastic layer formed by grinding, and the surface layer tends to be thinner on the projections. Therefore, the thickness of the surface layer from the external surface of the elastic layer must be about 2 μm or more. Further, for maintaining the resistance value of the charging roller, the thickness of the surface layer from the external surface of the elastic layer must be about 10 μm or less. If the thickness of the surface layer from the external surface of the elastic layer is less than about 2 μm, the surface layer cannot prevent the migration of bled or bloomed substances from the elastic layer to the surface layer, and if exceeding about 10 μm, the surface layer tends to have a high resistivity to readily deteriorate the charging property during long-term use. The thickness of the surface layer from the external surface of the elastic layer is preferably about 2 μm to about 10 μm, and more preferably about 3 μm to about 7 μm.

The thickness of the surface layer from the external surface of the elastic layer was measured as follows: the charging member according to an embodiment of the invention was cut out with a knife to give a cross-section, and the thickness of the surface layer in the areas in contact with the projections and depressions of the elastic layer was measured with a laser microscope.

The surface roughness Rz of the charging roller according to an embodiment of the invention is preferably about 10 μm or less, more preferably about 8 μm or less, and further preferably about 6 μm or less. If the surface roughness Rz is exceeding about 10 μm, irregularities may occur in the charging property, which results in the failure to uniformly charge the photoreceptor.

The surface roughness Rz was measured with SURFCOM 1400A (manufactured by Tokyo Seimitu Co., Ltd.), and calculated based on JIS B 0601.

The surface roughness may be adjusted, for example, but not limited to, by agglomerating conductive or semiconductive particles to be contained in the elastic layer, surface layer, and other layers, or by polishing the elastic layer, surface layer, and other layers.

The charging roller according to an embodiment of the invention has a proportion of water absorbed in the total the elastic layer being about 2% to about 8% by weight after storage for about 48 hours in an environment having a temperature of about 10° C. and a humidity of about 15% RH or a temperature of 28° C. and a humidity of 85% RH, and the proportion is preferably about 2% to about 6% by weight. If the proportion of water absorbed is less than about 2%, the resistance of the roller is severely changed by toner, external additives, discharge products and the like attached during long-term use, and if exceeding about 8%, the resistance is significantly changed with the use environment to vary the charging performance, which tends to result in abnormal image densities. Accordingly, when the roller has a proportion of water absorbed being about 2% to about 8% by weight after storage for 48 hours in an environment having a temperature of 10° C. and a humidity of 15% RH or a temperature of 28° C. and a humidity of 85% RH, the roller offers good electrical properties and highly stable image quality even after long-term repeated use. The proportion of water absorbed was determined as follows: the elastic layer and surface layer were cut out with a knife, stored in an environment having a temperature of 10° C. and a humidity of 15% RH or a temperature of 28° C. and a humidity of 85% RH for 48 hours, and then the moisture content was measured with a Karl Fischer method. The measurement of moisture content by the Karl Fischer method was performed as follows: the layers constituting the charging roller were stripped from the core material, and the contained water was vaporized with a vaporizer, the dehydrated solvent was introduced into a titration flask containing a solvent dehydrated with a Karl Fischer reagent, and titrated with the Karl Fischer reagent.

The above-described proportion of water absorbed being about 2% to about 8% by weight after storage for 48 hours in an environment having a temperature of 10° C. and a humidity of 15% RH or a temperature of 28° C. and a humidity of 85% RH may be achieved by, for example, adding a hydrophilic compound or a hydrophilic resin to at least one layer composing the charging roller, or surface treating the particles to be contained in the layer with a hydrophilic compound.

The dynamic ultra-microhardness of the charging roller according to an embodiment of the invention is preferably about 0.5 or less, and more preferably about 0.4 or less. The dynamic ultra-microhardness (hereinafter may be abbreviated as "DH") is a hardness calculated by the formula (2):

$$DH=\alpha\times P/D2 \quad (2)$$

wherein P is a test load (mN), D is an indentation depth (μm) as measured when an indenter is penetrated into a sample at a constant penetration rate (mN/s), and a is a constant according to the shape of the indenter. The dynamic ultra-microhardness was measured with a dynamic ultra-microhardness meter DUH-W201S (manufactured by Shimadzu Co., Ltd.). Dynamic ultra-microhardness is determined by soft material measurement, wherein a triangular pyramid indenter (vertex angle: 115°, α: 3.8584) is penetrated into the charging roll at a penetration rate of about 0.14 mN/s and a test load of about 10 mN, and the indentation depth D is measured.

<Image Forming Apparatus and Electrophotographic Process Cartridge>

The image forming apparatus and electrophotographic process cartridge according to an embodiment of the invention including the charging roller according to an embodiment of the invention as the charging unit are further described below. The image forming apparatus according to an embodiment of the invention includes: an electrophotographic photoreceptor; a charging unit which is disposed in contact with the electrophotographic photoreceptor and charges the electrophotographic photoreceptor to a predetermined electric potential; an electrostatic latent image forming unit which forms an electrostatic latent image on the charged surface of the electrophotographic photoreceptor; a development unit which transfers toner to the electrostatic latent image formed on the electrophotographic photoreceptor to visualize the image as a toner image; and a transfer unit which transfers the toner image to a receiving member, wherein the charging unit includes the charging roller according to an embodiment of the invention, and the electrophotographic photoreceptor is preferably charged through the application of a direct current alone to the charging roller.

FIG. 1 is a schematic view of an image forming apparatus according to an embodiment of the invention. The image forming apparatus shown in FIG. 1 includes an electrophotographic photoreceptor 1, a charging device (charging roller according to an embodiment of the invention) 2, a charging device cleaning device 3, a power supply 4, an exposure device (electrostatic latent image forming unit) 5, a development device (development unit) 6, a transfer device (transfer unit) 7, an electrophotographic photoreceptor cleaning device 8, a de-electrifying device 9, and a fixing device 11. The electrophotographic photoreceptor cleaning device 8 and the de-electrifying device 9 are provided if necessary.

The photoreceptor 1 comprise a photosensitive layer provided on the outer circumferential face of the conductive substrate. As the conductive substrate, a metal drum made of aluminum, copper, iron, stainless steel, zinc, or nickel may be used. Or the substrate may be prepared by vapor-depositing a metal such as aluminum, copper, gold, silver, platinum, palladium, titanium, nickel-chrome, stainless steel, copper or indium on a sheet, a paper, a plastic, or a glass. Or the substrate may be prepared by vapor-depsiting a conductive metal compound such as indium oxide or a tin oxide on a sheet, a paper, a plastic, or a glass. Or the substrate may be prepared by laminating a sheet, a paper, a plastic, or a glass with a metal foil. Or the substrate may be prepared by coating a sheet, a paper, a plastic, or a glass with a dispersion including a binder and a conductive material selected from carbon black, indium oxide, tin oxide, an antimony oxide powder, a metal powder, copper iodide and the like.

The shape of the conductive substrate is not limited to a drum shape, and may be a sheet shape and a plate shape. When the conductive substrate is a metal pipe, its surface may be unprocessed or may have been subjected to a process such as a mirror cutting, an etching, an anodic oxidation, a rough cutting, a centerless grinding, a sand blast, and a wet honing.

An undercoat layer may be optionally provided among the conductive substrate and the photosensitive layer if necessary.

Examples of the materials included in the undercoat layer include organometal compounds. Specific examples thereof include organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds, and aluminum coupling agents; antimony alkoxide compounds; germanium alkoxide compounds; indium alkoxide compounds; indium chelate compounds; manganese alkoxide compounds; manganese chelate compounds; tin alkoxide compounds; tin chelate compounds; aluminum silicon alkoxide compounds; aluminum titanium alkoxide compounds; aluminum zirconium alkoxide compounds. Organic zirconium compound, organic titanyl compound, and organic aluminium compound are preferable because photoreceptors including such compounds have low residual potentials and excellent electrophotographic characteristics.

The materials included in the undercoat layer may further include a silane coupling agent such as vinyltrichlorosilane, vinyltrimethoxysilane, vinyltriethoxysilane, vinyltris(2-methoxyethoxy)silane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3,4-epoxycyclohexyltrimethoxysilane.

Further, the known binder resin such as polyvinyl alcohol, polyvinyl methyl ether, poly-N-vinylimidazole, polyethylene oxide, ethylcellulose, methylcellulose, ethylene-acrylic acid copolymer, polyamide, polyimide, casein, gelatin, polyethylene, polyester, phenol resin, vinyl chloride-vinyl acetate copolymer, epoxy resin, polyvinylpyrrolidone, polyvinylpyridine, polyurethane, polyglutamic acid, or polyacrylic acid which have been used in an undercoating layer may be used. A ratio of mixing them may be appropriately set, if necessary.

In addition, an electron transporting organic pigment may be used in a mixed/dispersed state in an undercoating layer. Examples of the electron-transporting pigment include organic pigments described in Japanese Patent Application Laid-Open (JP-A) No. 47-30330, such as perylene pigment, bisbenzimidazole perylene pigment, polycyclic quinone pigment, indigo pigment, and quinacridone pigment, and organic pigments having an electron-withdrawing substituent such as a cyano group, nitro group, nitroso group, and halogen atom, examples thereof including bisazo pigment and phthalocyanine pigment. Among these pigments, perylene pigment, bisbenzimidazole perylene pigment, and polycyclic quinone pigment are preferable from the viewpoint of their high electron transfer property. These pigments may be surface treated with the above-described coupling agent or binder for the purpose of controlling the dispersibility and charge transporting properties.

If the content of the electron-transporting pigment is excessive, the strength of the undercoat layer may deteriorate, which may result in defects in the coating film. Therefore, the content of the electron-transporting pigment in the undercoat layer is preferably about 95% by weight or less, and more preferably about 90% by weight or less.

The undercoating layer may comprise semiconductive metal oxide fine particles. The semiconductive metal oxide fine particles for use in the invention have a volume resistivity of approximately about $10^2$ to about $10^{11}$ Ω·cm (at 20° C.). It is because the undercoat layer needs to have a suitable resistance for obtaining a certain leak resistance. Among many semiconductive metal oxide particles, use of the fine particles of a metal oxide such as titanium oxide, zinc oxide, tin oxide, or zirconium oxide having a power resistance in the range approximately about $10^2$ to about $10^{11}$ Ω·cm is preferable. Zinc oxide is particularly preferable. Metal oxide fine particles having a resistance lower than the lowest value of the range above may not provide a sufficiently high leak resistance, while those having a resistance higher than the highest value of the range may lead to increase in residual electric potential. The metal oxide fine particles may be used in combination of two or more kinds of particles, for example, different in surface finish or in particle diameter. In addition, the metal oxide fine particles preferably have a specific surface area of about 10 $m^2/g$ or more. Particles having a specific surface area of about 10 $m^2/g$ or less have a drawback of causing deterioration in electrostatic properties and thus prohibiting favorable electrophotographic properties.

The metal oxide fine particles may be subjected to a surface treatment. The surface-finishing agent may be selected from known materials such as silane coupling agents, titanate coupling agents, aluminum coupling agents, and surface-active agents if the material can provide desired properties. In particular, use of a silane-coupling agent, which provides favorable electrophotographic properties, is preferable. An amino group-containing silane coupling agent is used more preferably in the undercoat layer, because it provides a favorable blocking property.

The amino group-containing silane coupling agent is not particularly limited if it can provide the photoreceptor with favorable properties, and typical examples thereof include, but are not limited to, γ-aminopropyltriethoxysilane, N-β-(aminoethyl)-γ-aminopropyltrimethoxysilane, N-β-(aminoethyl)-γ-aminopropylmethyldimethoxysilane, N,N-bis(Θ-hydroxyethyl)-γ-aminopropyltriethoxysilane, and the like. The silane-coupling agents may be used in combination of two or more.

Examples of the silane coupling agents that may be used together with the amino group-containing silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxylsilane, γ-chloropropyltrimethoxysilane, and the like.

A dry method and a wet method is available as well as any other known method as the surface treatment method. When the surface treatment is carried out by a dry method, metal oxide fine particles are uniformly processed by adding a silane coupling agent directly or adding a solution thereof in an organic solvent and spraying the drops with a dry air or nitrogen gas stream onto the metal oxide particles while agitating the metal oxide particles in a high-shear-force mixer. During addition or spraying, the temperature is preferably kept lower than the boiling point of the solvent. Spraying at a temperature of the boiling point of the solvent or higher, causes, in some cases, evaporation of the solvent before the silane coupling agent is uniformly distributed and local aggregation of the silane coupling agent and thus prohibits uniform processing. The metal oxide fine particles after addition or spraying may be baked additionally at 100° C. or more. The baking may be carried out under any condition if it is suitable temperature and time for obtaining desirable electrophotographic properties.

When the surface treatment is carried out by the wet method, metal oxide fine particles are processed uniformly by dispersing the metal oxide fine particle in a solvent by means of a agitator, ultrasonicator, sand mill, attriter, ball mill, or the like, adding a silane coupling agent solution thereto, stirring or dispersing the resulting mixture, and removing the solvent. The solvent is commonly removed by filtration or distillation. The metal oxide fine particles may be baked additionally at a temperature of 100° C. or more after removing the solvent. The baking may be carried out under any condition if it is suitable temperature and time for obtaining desirable electrophotographic properties. Water contained in the metal oxide fine particles may be removed before addition of a surface finishing agent in the wet method, for example, by heating and stirring the particles in a solvent for surface treatment or by azeotropic distillation with the solvent.

The amount of the silane coupling agents to that of the metal oxide fine particles in the undercoating layer may be freely determined in the range that provides desired electrophotographic properties.

In addition, metal oxide fine particles in the undercoating layer may have the electron acceptor compound.

Any compound may be used as the electron acceptor compound according to the invention if it has a group reactive with the metal oxide fine particles providing desired properties, and in particular, a compound having a hydroxyl group is preferable. An electron acceptor compound having an anthraquinone structure containing a hydroxyl group is particularly preferable. Examples of the electron acceptor compounds having an anthraquinone structure containing a hydroxyl group include hydroxyanthraquinone compounds, aminohydroxyanthraquinone compounds, and the like, and any compound may be used favorably. Specific favorable examples of the electron acceptor compounds include alizarin, quinizarin, anthrarufin, purpurin, 1-hydroxyanthraquinone, 2-amino-3-hydroxyanthraquinone, 1-amino-4-hydroxyanthraquinone, and the like.

The content of the electron acceptor compound used in the invention may be freely determined in the range that provides desired properties, and is preferably in the range of about 0.01 to about 20 weight % and more preferably in the range of about 0.05 to about 10 weight % with respect to metal oxide fine particles. Metal oxide fine particles having an electron acceptor content of about 0.01 weight % or less may not be effective in providing a sufficient electron acceptor capacity for preventing the accumulation of electric charges in undercoat layer and often result in deterioration in the consistency of photoreceptor, for example, increase of residual electric potential during repeated use. Alternatively, an electron acceptor compound having a content of about 20 weight % or more may cause aggregation of metal oxide particles, which prohibit formation of favorable conductive paths in the undercoat layer when the undercoat layer is formed, leading to deterioration in consistency, for example, increase of residual electric potential during repeated use and consequently image quality defects such as black spot and the like.

The binder resin contained in the undercoat layer is not particularly limited if it gives a favorable film and provides the film with desired properties, and examples thereof include known polymer compounds including acetal resins such as polyvinyl butyral, polyvinyl alcohol resins, casein, polyamide resins, cellulosic resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; electric charge-transporting resins having a charge-transporting group; conductive resins such as polyaniline; and the like. Among them, a resin insoluble in the coating solution for upper layer is preferable, and favorable examples thereof include phenol resins, phenol-formaldehyde resins, melamine resins, urethane resins, epoxy resins and the like.

The ratio of an amount of the metal oxide fine particles to that of the binder resin in the coating liquid used for providing the undercoating layer (the coating solution for forming the undercoat layer) may be freely determined in the range that provides desired electrophotographic properties.

The coating solution for forming the undercoat layer may contain additionally various additives, for improvement in electrical properties, environment stability, and/or image quality.

Examples of such additives include electron-transporting material including quinone compound such as chloranil and bromoanil, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl) 1,3,4oxadiazole, xanthone compounds, thiophene compounds, and diphenoquinone compounds such as 3,3',5,5'-tetra-t-butyldiphenoquinone; electron transporting pigments such as polycyclic condensation pigments and azo pigments; known materials such as zirconium chelate compounds, titanium chelate compounds, aluminum chelate compounds, titanium alkoxide compounds, organic titanium compounds, and silane coupling agents; and the like.

Silane coupling agents are used for surface treatment of metal oxides, but may be used also as an additive in the coating solution. Typical examples of the silane coupling agents usable include vinyltrimethoxysilane, γ-methacryloxypropyl-tris(β-methoxyethoxy)silane, β-(3,4-epoxycyclohexyl)ethyltrimethoxysilane, δ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane, and the like. Examples of the zirconium chelate compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the titanium chelate compounds include tetraisopropyl titanate, tetra-n-butyl titanate, butyl titanate dimer, tetra(2-ethylhexyl)titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the aluminum chelate compounds include aluminum isopropylate, monobutoxyaluminum diisopropylate, aluminum butylate, ethylacetoacetatoaluminum diisopropylate, aluminum tris(ethylacetoacetate), and the like.

These compounds may be used alone or as a mixture or polycondensate of multiple compounds.

The solvent for preparing the coating solution for forming the undercoat layer may be selected freely from known organic solvents: for example, alcohols, aromatic hydrocarbons, halogenated hydrocarbons, ketones, ketone alcohols, ethers, and esters. For example, common organic solvents such as methanol, ethanol, n-propanol, iso-propanol, n-butanol, benzylalcohol, methylcellosolve, ethylcellosolve, acetone, methylethylketone, cyclohexanone, methyl acetate, ethyl acetate, n-butyl acetate, dioxane, tetrahydrofuran, methylene chloride, chloroform, chlorobenzene, and toluene may be used.

In addition, the solvents above for dispersion may be used alone or as a mixture of two or more. Any solvents may be used as the solvents for use in the mixture, if the mixed solvent can dissolve the binder resin.

The metal oxide fine particles and the electron acceptor compound having a group reactive with the metal oxide fine particles may be blended by any one of known means including roll mill, ball mill, vibration ball mill, attriter, sand mill, colloid mill, and paint shaker. Further, the undercoat layer may be formed by any one of the methods commonly practiced in the art including blade coating, wire bar coating, spray coating, dip coating, bead coating, air knife coating, curtain coating, and other methods.

In the undercoat layer, the reaction between the metal oxide fine particles and the electron acceptor compound having a group reactive with the metal oxide fine particles may occur during the dispersing process, or during drying the coated layer for curing, and preferably occur in the dispersion liquid for uniform reaction.

The resulting coating solution for forming the undercoat layer is used for forming an undercoat layer on a conductive substrate.

The Vickers strength of the undercoat layer is preferably 35 or more.

Further, the thickness of the undercoat layer may be freely determined in the range that provides desired properties, and the thickness is preferably 5 μm or more, and further preferably 5 μm to 50 μm. If the thickness of the undercoat layer is less than 5 μm, sufficient leak resistance may not be achieved, and if exceeding 50 μm, residual electric potential tends to remain after long-term use, which may cause abnormal image densities.

The surface roughness of the undercoat layer is adjusted to ¼n (n represents the refractive index of upper layer) to ½ of the wavelength λ of the exposure laser used for prevention of moire images. Resin particles may be added to the undercoat layer for adjustment of the surface roughness. The usable resin particles are, for example, silicone resin particles, cross-linked PMMA resin particles, or the like.

Alternatively, the undercoat layer may be polished for adjustment of the surface roughness. The polishing methods include buffing, sand blasting, wet honing, grinding treatment, and the like.

In addition, an intermediate layer may be formed between the undercoat layer and the photosensitive layer for improvement in the electrical properties, image quality, image quality endurance, and the adhesiveness of photosensitive layer.

The intermediate layer contains a polymer resin compound such as acetal resin represented by polyvinyl butyral, polyvinyl alcohol resin, casein, polyamide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone- alkyd resin, phenol-formaldehyde resin, melamine resin, or the like; as well as an organic metal compound containing a zirconium, titanium, aluminum, manganese, silicon, or other atom. These compounds may be used alone or as a mixture or polycondensate of multiple compounds. Among them, the organic metal compound containing a zirconium, titanium, aluminum, or the silane coupling agent is superior in properties, as it has a lower residual electric potential, a smaller fluctuation in electric potential by the environment, and a smaller fluctuation in electric potential by repeated use.

Examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxylsilane, γ-chloropropyltrimethoxysilane, and the like. The silicon compounds particularly favorably used among them include vinyltriethoxylsilane, vinyltris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropylmethyldimethoxysilane, 3-aminopropyltriethoxylsilane, N-phenyl-3-aminopropyltrimethoxysilane, 3-mercaptopropyltrimethoxysilane, 3-chloropropyltrimethoxysilane, and the like.

Examples of the organic zirconium compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the organic titanium compounds include tetraisopropyl titanate, tetra-n-butyl titanate, butyl titanate dimer, tetra(2-ethylhexyl)titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the organic aluminum compounds include aluminum isopropylate, monobutoxyaluminum diisopropylate, aluminum butylate, ethylacetoacetatoaluminum diisopropylate, aluminum tris(ethylacetoacetate), and the like.

The intermediate layer improves the coatability to the upper layer and also serves as an electrical blocking layer. However, if the film thickness is excessive, the layer has a too strong electrical barrier property, which may result in desensitization or the decrease in the electrical potential because of repeated use. Accordingly, when an intermediate layer is formed, the film thickness is preferably determined in the range of 0.1 to 5 μm.

The charge generating layer composing the photosensitive layer is formed by vacuum deposition of an electric charge generating substance, or by dispersion coating with a mixture of an electric charge generating substance, organic solvent, and binding resin.

When the charge generating layer is formed by dispersion coating, a charge generating substance is dispersed together with an organic solvent, binding resin, and other additives, and the resulting dispersion liquid is applied to form the charge generating layer.

In the invention, the charge generating substance may be any known charge generating substance. The charge generating agent for infrared light may be a phthalocyanine pigment, squarylium, bisazo, trisazo, perylene or dithioketopyrrolopyrrole. The charge generating agent for visible light may be a condensed polycyclic pigment, a bisazo, a perylene, a trigonalselen, or a metal oxide fine particle sensitized with a dye. Particularly, phthalocyanine pigments or azo pigments are preferable because of its excellent characteristics. When phthalocyanine pigments or azo pigments are used, the electrophotographic photoreceptor has a high sensitivity and a high stability over repeated use.

Generally, phthalocyanine pigments or azo pigments each can take several crystal forms, and the crystal forms are not limited as long as a sensitivity suitable for the use can be obtained. Preferable examples of the charge generating substance to be used include chlorogallium phthalocyanine, dichlorotin phthalocyanine, hydroxygallium phthalocyanine, non-metal phthalocyanine, oxytitanyl phthalocyanine, and chloroindium phthalocyanine.

The phthalocyanine pigment crystals may be prepared by dry pulverization of a phthalocyanine pigment prepared by a known method mechanically in an automatic mortar, planetary mill, vibrating mill, CF mill, roller mill, sand mill, kneader, or the like; or by wet pulverization additionally of the crystal after dry pulverization together with a solvent in a ball mill, mortar, sand mill, kneader, or the like.

Examples of the solvent used in the processing above include aromatic compounds (toluene, chlorobenzene, etc.), amides (dimethylformamide, N-methylpyrrolidone, etc.), aliphatic alcohols (methanol, ethanol, butanol, etc.), aliphatic polyvalent alcohols (ethylene glycol, glycerol, polyethylene glycol, etc.), aromatic alcohols (benzyl alcohol, phenethyl alcohol, etc.), esters (acetic acid esters, butyl acetate, etc.), ketones (acetone, methylethylketone, etc.), dimethylsulfoxide, ethers (diethylether, tetrahydrofuran, etc.), as well as several-solvent mixture systems, mixture systems of these organic solvents and water. The solvent is used in the range of about 1 to about 200 parts, preferably about 10 to about 100 parts by weight, with respect to 100 parts of the pigment crystal by weight.

The processing temperature is in the range of about −20° C. to the boiling point of the solvent and more preferably in the range of about −10 to about 60° C. A grinding aid such as sodium chloride or sodium sulfate may additionally used during pulverization. The grinding aid is used in an amount of about 0.5 to about 20 times, preferably about 1 to about 10 times, of that of the pigment.

The crystalline state of phthalocyanine pigment crystals prepared by a known method can be controlled by acid pasting or by a combination of acid pasting and the dry or wet pulverization described above. A favorable acid for the acid pasting is sulfuric acid at a concentration of preferably about 70 to about 100% by weight, more preferably about 95 to about 100% by weight, and the favorable solubilization temperature is in the range of about −20 to about about 100° C. and more preferably in the range of about −10 to about 60° C. The amount of the conc. sulfuric acid solution is in the range of about 1 to about 100 times, preferably about 3 to about 50 times larger than that of phthalocyanine pigment crystal. Water or a mixture of water and an organic solvent is used in an arbitrary amount as a precipitation solvent. The precipitation temperature is not particularly limited, but the pigment solution is preferably cooled, for example, with ice for prevention of overheating.

The binder resin for use in the charge-generating layer may be selected from a wide range of insulating resins and organic photoconductive polymers such as poly-N-vinylcarbazole, polyvinylanthracene, polyvinylpyrene, and polysilane. Favorable examples of the binder resins include, but are not limited to, insulating resins such as polyvinyl acetal resins, polyarylate resins (polycondensation polymers from bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulosic resins, urethane resins, epoxy resins, casein, polyvinyl alcohol resins, polyvinylpyrrolidone resins. These binder resins may be used alone or in combination of two or more. Polyvinyl acetal resins are particularly preferably used among them.

In the coating solution for forming the charge-generating layer, the blending ratio (weight ratio) of the charge-generating substance to the binder resin is preferably in the range of about 10:1 to about 1:10. The solvent for preparation of the coating solution is selected arbitrarily form known organic solvents such as alcohols, aromatic compounds, halogenated hydrocarbons, ketones, ketone alcohols, ethers, esters, and the like. For example, common organic solvent such as methanol, ethanol, n-propanol, iso-propanol, n-butanol, benzyl alcohol, methylcellosolve, ethylcellosolve, acetone, methylethylketone, cyclohexanone, methyl acetate, ethyl acetate, n-butyl acetate, dioxane, tetrahydrofuran, methylene chloride, chloroform, chlorobenzene, and toluene may be used.

The solvents for dispersion of the charge-generating substance and the binder resin may be used alone or in combination of two or more. Any solvent may be used for mixing if it is capable of dissolving the binder resin.

The dispersing methods to be used include, for example, a roll mill, ball mill, vibration ball mill, attriter, sand mill, colloid mill, paint shaker or the like. The charge-generating layer may be applied by any one of common methods including blade coating, wire bar coating, spray coating, dip coating, bead coating, air knife coating, and curtain coating methods.

In addition, control of the diameter of the particles in the dispersion to about 0.5 μm or less, preferably about 0.3 μm or less, and more preferably about 0.15 μm or less, is effective for improvement in sensitivity and stability.

The surface of the charge-generating substance may be additionally treated for stabilization of electrical properties and prevention of image quality defects. The surface treatment agents include, but are not limited to, coupling agents. Examples of the coupling agents for use in the surface treatment include silane coupling agents such as vinyltrimethoxysilane, γ-methacryloxypropyl-tris(β-methoxyethoxy)silane, β-(3,4-epoxycyclohenxy)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxylsilane, and γ-chloropropyltrimethoxysilane. Silane coupling agents particularly favorably used among them include vinyltriethoxylsilane, vinyltris(2-methoxyethoxy)silane, 3-methacryloxypropyltrimethoxysilane, 3-glycidoxypropyltrimethoxysilane, 2-(3,4-epoxycyclohexyl) ethyltrimethoxysilane, N-2-(aminoethyl)-3-aminopropyltrimethoxysilane, N-2-(aminoethyl)-3-aminopropylmethyldimethoxysilane, 3-aminopropyltriethoxylsilane, N-phenyl-3-aminopropyltrimethoxysilane, 3-mercaptopropyltrimethoxysilane, and 3-chloropropyl trimethoxysilane.

Further, organic zirconium compounds including zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like may also be used.

In addition, organic titanium compounds such as tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethylester, titanium triethanolaminate, and polyhydroxytitanium stearate; and organic aluminum compounds such as aluminum isopropylate, monobutoxyaluminum diisopropylate, aluminum butylate, ethylacetoacetatoaluminum diisopropylate and aluminum tris(ethylacetoacetate) may also be used.

Various additives may be added additionally to the coating solution for the charge-generating layer for improvement in electrical properties and image quality. Examples of the additives include electron-transporting materials including quinone compounds such as chloranil, bromoanil and anthraquinone; tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)1,3,4-oxadiazole, xanthone compounds, thiophene compounds, and diphenoquinone compounds such as 3,3',5,5'-tetra-t-butyl diphenoquinone; electron-transporting pigments such as polycyclic condensation and azo pigments; known materials such as zirconium chelate compounds, titanium chelate compounds, aluminum chelate compounds, titanium alkoxide compounds, organic titanium compounds, and silane coupling agents; and the like.

Examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxylsilane, γ-chloropropyltrimethoxysilane, and the like.

Examples of the zirconium chelate compounds include zirconium butoxide, zirconium ethylacetoacetate, zirconium triethanolamine, acetylacetonatozirconium butoxide, ethylacetoacetatozirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylatozirconium butoxide, stearatozirconium butoxide, isostearatozirconium butoxide, and the like.

Examples of the titanium chelate compounds include tetraisopropyl titanate, tetra-n-butyl titanate, butyl titanate dimer, tetra(2-ethylhexyl)titanate, titanium acetylacetonate, poly titanium acetylacetonate, titanium octyleneglycolate, titanium lactate ammonium salt, titanium lactate, titanium lactate ethylester, titanium triethanolaminate, polyhydroxytitanium stearate, and the like.

Examples of the aluminum chelate compounds include aluminum isopropylate, monobutoxyaluminum diisopropylate, aluminum butylate, ethylacetoacetatoaluminum diisopropylate, aluminum tris(ethylacetoacetate), and the like.

These compounds may be used alone or as a mixture or polycondensate of multiple compounds.

The charge-generating layer may be formed by any one of methods commonly practiced in the art including blade coating, wire bar coating, spray coating, dip coating, bead coating, air knife coating, curtain coating, and other methods.

Any known charge-transporting compound may be used as the charge-transporting substance contained in the charge-transporting layer 32, and examples thereof include: hole-transporting materials including oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-dietylaminostyryl)-5-(p-diethylaminostyiyl) pyrazoline, aromatic tertiary amino compounds such as triphenylamine, tri(p-methyl)phenylamine, N,N'-bis(3,4-dimethylphenyl)-biphenyl-4-amine, dibenzylaniline, and 9,9-dimethyl-N,N'-di(p-tolyl)fluorenon-2-amine, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4-methoxyphenyl)-1,2,4-triazine, hydrazone derivatives such as 4-diethylaminobezaldehyde-1,1-diphenyl hydrazone, 4-diphenylaminobezaldehyde-1,1-diphenylhydrazone, and [p-(diethylamino)phenyl](1-naphthyl)phenylhydrazone, quinazoline derivatives such as 2-phenyl-4-styryl-quinazoline, benzofuran derivatives such as 6-hydroxy-2,3-di(p-methoxyphenyl)-benzofuran, α-stilbene derivatives such as p-(2,2-diphenylvinyl)-N,N'-diphenylaniline, enamine derivatives, carbazole derivatives such as N-ethylcarbazole, poly-N-vinyl carbazole and the derivatives thereof; and electron-transporting materials including quinone compounds such as chloranil, bromoanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethyl amino phenyl)1,3,4-oxadiazole, xanthone compounds, thiophene compounds, diphenoquinone compound such as 3,3',5,5"-tetra-t-butyl-diphenoquinone; and polymers having groups containing the compounds above on the main or side chains, and the like. These charge-transporting substances may be used alone or in combination of two or more.

A binder resin of the charge transport layer 23 may be any known resin, but is preferably a resin capable of forming an electroinsulating film.

For example there can be employed an insulating resin such as a polycarbonate resin, a polyester resin, a polyarylate resin, a methacrylic resin, an acrylic resin, a polyvinyl chloride resin, a polyvinylidene chloride resin, a polystyrene resin, an acrylonitrile-styrene copolymer, an acrylonitrile-butadiene copolymer, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, polyvinylbutyral, polyvinylformal, polysulfon, casein, gelatin, polyvinyl alcohol, ethyl cellulose, phenol resin, polyamide, polyacrylamide, carboxy-methyl cellulose, vinylidene chloride-based polymer wax, or polyurethane, or a polymer charge transport material such as polyvinylcarbazole, polyvinylanthracene, polyvinylpyrene, polysilane or a polyester-based polymer charge transport material disclosed in JP-A Nos. 8-176293 and 8-208820. Such binder resin may be employed singly or in a mixture of two or more kinds.

Such binder resin, which can be employed singly or in a mixture of two or more kinds, is particularly preferably a polycarbonate resin, a polyester resin, a methacrylic resin or an acrylic resin in consideration of a mutual solubility with the charge transport material, a solubility in the solvent and a strength. A composition ratio (weight ratio) of the binder resin and the charge transfer substance can be arbitrarily selected in any case, but attention has to be paid to decreases in the electrical characteristics and in the film strength.

It is also possible to use a polymer charge transport material singly. As the polymer charge transport material, any known material having a charge transport property such as poly-N-vinylcarbazole or polysilane may be employed. In particular, a polyester polymer charge transport material disclosed in JP-A Nos. 8-176293 and 8-208820 is particularly preferable, having a high charge transporting property. The polymer charge transport material may be singly used as the charge transport layer, but it may formed into a film in a mixture with the aforementioned binder resin.

The charge transport layer, in case it is a surface layer of the electrophotographic photoreceptor (namely a layer in the photosensitive layer farthest from the conductive substrate), preferably contains lubricating particles (such as silica particles, alumina particles, fluorinated resin particles such as of polytetrafluoroethylene (PTFE), or silicone resin particles) for providing a lubricating property thereby retarding abrasion of the surface layer or avoiding scratches, and improving a cleaning property for a developer deposited on the surface of the photoreceptor. Such lubricating particles may be employed in a mixture of two or more kinds. In particular, fluorinated resin particles can be employed preferably.

For the fluorinated resin particles, one or more kinds are preferably selected from a tetrafluoroethylene resin, a trifluorochloroethylene resin, a hexafluoropropylene resin, a fluorinated vinyl resin, a fluorinated vinylidene resin, a difluorodichloroethylene resin and copolymers thereof, and a tetrafluoroethylene resin or a fluorinated vinylidene resin is particularly preferable.

The aforementioned fluorinated resin preferably has a primary particle size of about 0.05 to about 1 μm, more preferably about 0.1 to about 0.5 μm. A primary particle size less than about 0.05 μm may tend to result in an agglomeration at or after dispersing operation. Also a size exceeding about 1 μm may tend to generate image defects.

In a charge transport layer containing a fluorinated resin, a content of the fluorinated resin in the charge transport layer is preferably about 0.1 to about 40 weight % with respect to the entire amount of the charge transport layer, particularly preferably about 1 to about 30 weight %. A content less than about 1 weight % may be insufficient for a modifying effect by the dispersed fluorinated resin particles, while a content exceeding about 40 weight % may deteriorate an optical transmittance and may cause an increase in the residual potential in repeated uses.

The charge transport layer can be prepared by coating and drying a coating liquid for the charge transport layer, prepared by dissolving the charge transport material, the binder resin and other materials in a suitable solvent.

A solvent to be used for forming the charge transport layer can be an aromatic hydrocarbon solvent such as toluene or chlorobenzene, an aliphatic alcohol solvent such as methanol, ethanol or n-butanol, a ketone solvent such as acetone, cyclohexanone or 2-butanone, a halogenated aliphatic hydrocarbon solvent such as methylene chloride, chloroform or ethylene chloride, a cyclic or linear ether solvent such as tetrahydrofuran, dioxane, ethylene glycol or diethyl ether, or a mixed solvent thereof. A composition ratio of the charge transport material and the binder resin is preferably about 10:1 to about 1:5 (the charge transport material: the binder resin; weight ratio).

In the coating liquid for forming the charge transport layer, a small amount of a leveling agent such as silicone oil may be added for improving smoothness of the coated film.

The fluorinated resin can be dispersed in the charge transport layer for example with a roll mill, a ball mill, a vibrating ball mill, an attriter, a sand mill, a high pressure homogenizer, an ultrasonic disperser, a colloid mill, a collision type medialess disperser or a penetration type medialess disperser.

The coating liquid for forming the charge transport layer can be prepared, for example, by dispersing fluorinated resin particles in a solution formed by dissolving the binder resin, the charge transport material and the like in the solvent.

In a process of preparing the coating liquid for forming the charge transport layer, the coating liquid is preferably controlled within a temperature range of 0° C. to 50° C.

For controlling the temperature of the coating liquid at 0° C. to 50° C. in the coating liquid manufacturing process, there can be utilized a method of cooling with water, a method of cooling with wind, a method of cooling with a coolant, a method of regulating a room temperature in the manufacturing process, a method of warming with warm water, a method of warming with hot air, a method of warming with a heater, a method of preparing a coating liquid manufacturing facility with a material that does not generate heat easily, a method of preparing a coating liquid manufacturing facility with a material capable of easy heat dissipation, or a method of preparing a coating liquid manufacturing facility with a material capable of easy heat accumulation.

An addition of a small amount of an auxiliary dispersant is also effective for improving the dispersion stability of the dispersed liquid and for preventing agglomeration in forming a coated film. The auxiliary dispersant can be a fluorinated surfactant, a fluorinated polymer, a silicone polymer or a silicone oil. It is also effective to in advance disperse, agitate and mix the fluorinated resin and the aforementioned auxiliary dispersant in a small amount of a dispersing solvent, then agitate and mix thus obtained dispersion with a solution formed by mixing and dissolving the charge transport material, the binder resin and the dispersing solvent, and then executing a dispersion in the aforementioned method.

A coating method for forming the charge transport layer can be, for example, a dip coating method, a fountain extrusion coating method, a spray coating method, a roll coating method, a wire bar coating method, a gravure coating method, a bead coating method, a curtain coating method, a blade coating method or an air knife coating method.

The charge transport layer preferably has a film thickness of about 5 to about 50 μm, more preferably about 10 to about 45 μm.

Furthermore, in the electrophotographic photoreceptor of the present invention, an additive such as an antioxidant or a photostabilizer can be added in the photosensitive layer, for the purpose of preventing deterioration of the electrophotographic photoreceptor by ozone or an oxidative gas generated in the electrophotographic apparatus or by light or heat. The antioxidant can be, for example, hindered phenol, hindered amine, paraphenylenediamine, arylalkane, hydroquinone, spirochroman, spiroindanone, a derivative of the foregoing compounds, an organic sulfur compound or an organic phosphor compound.

Specific examples of the antioxidant, in a phenolic antioxidant, include 2,6-di-t-butyl-4-methylphenol, styrenized phenol, n-octadecyl-3-(3',5'-di-t-butyl-4'-hydroxyphenyl)propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl) isocyanurate, tetrakis-[methylene-3-(3',5'-di-t-butyl-4'-hydroxyphenyl)propionate]-methane, and 3,9-bis[2-[3-(3-t-butyl-4-hydroxy-5-methylphenyl)propionyloxy]1,1-dimethylethyl]-2,4,8,10-tetraoxaspiro[5,5]undecane.

Those of a hindered amine compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-6-tetramethyl-4-piperidyl)imino}hexamethylene{(2,3,6,6-tetramethyl-4-piperidyl)imino}], 2-(3,5-di-t-butyl-4-hydroxybenzyl)-2-n-butyl malonate bis(1,2,2,6,6-pentamethyl-4-piperidyl), and N,N'-bis(3-aminopropyl) ethylenediamine-2,4-bis[N-butyl-N-(1,2,2,6,6-pentamethyl-4-piperidyl)amino]-6-chloro-1,3,5-triazine condensate.

Examples of the organic sulfur-containing antioxidant include dilauryl-3,3'-thiodipropionate, dimyristyl-3,3'-thiodipropionate, distearyl-3,3'-thiodipropionate, pentaerythritol-tetrakis(β-lauryl-thiopropionate), ditridecyl-3,3'-thiodipropionate, and 2-mercaptobenzimidazole.

Also examples of the organic phosphor-containing antioxidant include trisnonylphenyl phosphite, triphenyl phosphite, and tris(2,4-di-t-butylphenyl)phosphite.

The organic sulfur-containing antioxidant or the organic phosphor-containing antioxidant is called a secondary antioxidant which can be used in combination with a primary antioxidant of a phenol type or an amine type to obtain a multiplying effect.

A photostabilizer can be derivatives of benzophenone, benzotriazole, dithiocarbamate, or tetramethylpiperidine.

Examples of the benzophenone-based photostabilizer include 2-hydroxy-4-methoxybenzophenone, 2-hydroxy-4-octoxybenzophenone, and 2,2'-di-hydroxy-4-methoxybenzophenone.

Examples of the benzotriazole-based photostabilizer include 2-(2'-hydroxy-5'-methylphenyl)benzotriazole, 2-[2'-hydroxy-3'-(3",4",5",6"-tetra-hydrophthalimidemethyl)-5'-methylphenyl]benzotriazole, 2-(2'-hydroxy-3'-t-butyl-5'-methylphenyl)-5-chlorobenzotriazole, 2-(2'-hydroxy-3',5'-di-t-butylphenyl)benzotriazole, 2-(2'-hydroxy-5'-t-octylphenyl) benzotriazole, and 2-(2'-hydroxy-3',5'-di-t-amylphenyl) benzotriazole.

Other compounds include 2,4-di-t-butylphenyl-3',5'-di-t-butyl-4'-hydroxybenzoate and nickel dibutyl-dithiocarbamate.

Also at least an electron-accepting substance may be included for the purposes of improving the sensitivity, reducing the residual potential and reducing a fatigue in repeated uses.

Such electron accepting substance can be, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid or phthalic acid. Among these, particularly preferred are a fluorenone compound, a quinone compound and a benzene derivative having an electron attracting substituent such as Cl, CN or $NO_2$.

In the invention an overcoat layer may be formed on the charge transport layer if necessary. The overcoat layer is used, in an electrophotographic photoreceptor of a laminar structure, for preventing a chemical change in the charge transport layer at charging, and for improving the mechanical strength of the photosensitive layer.

The overcoat layer can be formed as a resinous cured film containing a curable resin and a charge transporting compound, or a film constituted by including a conductive material in a suitable binder resin. The curable resin may be any known resin, such as a phenolic resin, an urethane resin, a melamine resin, a diallyl phthalate resin or a siloxane resin.

The charge transporting compound may be the same charge transporting substance as that used for the charge transport layer. Examples of the conductive material include, but not limited to, metallocene compounds such as dimethylferrocene, and metal oxides such as antimony oxide, tin oxide, titanium oxide, oxidation indium, and ITO.

The volume resistivity (20° C.) of the overcoat layer is preferably in the range of about $10^9$ to about $10^{14}$ Ω·cm. If the electrical resistance is exceeding about $10^{14}$ Ω·cm, the residual electric potential may increase, and if less than about $10^9$ Ω·cm, charge leaks along the surface are nonnegligible, which may result in the decrease in the resolution.

The film thickness of the overcoat layer is preferably in the range of about 0.1 to about 20 μm, and more preferably in the range of about 1 to about 10 μm. In cases where a overcoat layer is formed, if necessary, a blocking layer may be formed between the photosensitive layer 3 and the overcoat layer for preventing charge leaks from the overcoat layer to the photosensitive layer 3. The blocking layer may be composed of any known material as that used for the overcoat layer.

In the overcoat layer, a fluorine atom-containing compound may be added for the purpose of providing a surface lubricating property. An increase in the surface lubricating property can reduce a friction coefficient with a cleaning member and can improve the abrasion resistance. It may also have an effect of preventing deposition of a discharge product, a developer and paper dusts onto the surface of the electrophotographic photoreceptor, thereby extending the service life thereof.

As specific examples of the fluorine-containing compound, it is possible to add a fluorine atom-containing polymer such as polytetrafluoroethylene directly, or to add fine particles of such polymer.

An amount of addition of the fluorine-containing compound is preferably about 20 weight % or less. An exceeding amount may cause a defect in the film forming property of the crosslinked cured film.

The aforementioned overcoat layer has a sufficient antioxidation property, but an antioxidant may be added in order to obtain an even stronger antioxidation property.

The antioxidant is preferably a hindered phenol type or a hindered amine type, but it is also possible to employ a known antioxidant such as an organic sulfur-based antioxidant, a phosphite antioxidant, a dithiocarbamate antioxidant, a thiourea antioxidant, or an benzimidazole antioxidant. An amount of addition of the antioxidant is preferably about 15 weight % or less in the overcoat layer, more preferably about 10 weight % or less.

Examples of the hindered phenol type antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzyl phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenyl), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

In the overcoat layer, other known additives employed in film formation may be added, such as a leveling agent, an ultraviolet absorber, a photostabilizer, a surfactant and the like.

The overcoat layer is formed by coating a mixture of the aforementioned materials and other additives on the photosensitive layer, followed by heating. In this manner a three-dimensional crosslinking curing reaction is induced to form a firm cured film. The heating may be executed at any temperature not influencing the underlying photosensitive layer, but is preferably executed within a range from room temperature to about 200° C., particularly from about 100° C. to about 160° C.

In forming the overcoat layer, the crosslinking curing reaction may be executed without a catalyst or with a suitable catalyst. The catalyst can be an acid catalyst such as hydrochloric acid, sulfuric acid, phosphoric acid, formic acid, acetic acid or trifluoroacetic acid; a base such as ammonia or triethylamine; an organic tin compound such as dibutyl tin diacetate, dibutyl tin dioctoate or stannous octoate; an organic titanium compound such as tetra-n-butyl titanate or tetraisopropyl titanate; or an iron salt, a manganese salt, a cobalt salt, a zinc salt, a zirconium salt or an aluminum chelate compound of an organic carboxylic acid.

In the overcoat layer, a solvent may be added, if necessary, in order to facilitate coating. More specifically there can be employed water or an ordinary organic solvent such as methanol, ethanol, n-propanol, i-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether or dibutyl ether. Such solvent may be employed singly or in a mixture of two or more kinds.

In forming the overcoat layer, the coating can be executed by an ordinary coating method such as blade coating, Meyer bar coating, spray coating, dip coating, bead coating, air knife coating, or curtain coating. The overcoat layer has a thickness of about 0.5 to about 20 μm, preferably about 2 to about 10 μm.

As shown in FIG. 1, the image forming apparatus and the below-described electrophotographic process cartridge according to an embodiment of the invention preferably include a charging device cleaning device (cleaning member)3 which cleans the surface of the above-described charging roller according to an embodiment of the invention for removing toner, external additives contained in the toner, dust, and the like from the surface of the charging roll to prevent the occurrence of image quality defects due to the deterioration of the charging property and charging irregularities.

The charging device cleaning device 3 is, for example, in a roll form composed of an elastic layer formed on a core material, a blade form composed of a single elastic layer or a plurality of elastic layers, or a brush form composed of a number of fibers. The cleaning device is preferable in a roll form from the viewpoint of cleaning performance.

In cases where the charging device cleaning device 3 includes a roll-form cleaning member, the core material of the cleaning member may be composed of a metal such as iron, copper, brass, stainless steel, aluminum, or nickel, or a resin molding. The material preferably has enough strength against bending for achieving a uniform contact with the charging unit to provide desired properties.

Further, the core material preferably has a diameter which causes less bending for achieving a uniform contact with the charging unit to provide desired properties.

For exerting a higher cleaning effect on the charging device 2, the elastic layer of the charging device cleaning device 3 preferably includes a porous foam or cloth, more preferably a porous foam, and further preferably a porous foam composed of one or more materials selected from the group consisting of urethane resins, melamine resins, acrylic resins, cellulose resins, polyamide resins, polyethylene resins, polyester resins, polypropylene resins, polystyrene resins, polyvinyl chloride resins, vinyl acetate resins, and silicone resins. Further the porous foam may be reinforced by immersion in a resin solution or a conductive substance-containing resin solution.

The exposure device 5 exposes the charged electrophotographic photoreceptor 1 to form an electrostatic latent image. The light source of the exposure device 5 is preferably a multibeam system surface emitting laser.

The transfer device 7 transfers a toner image on the electrophotographic photoreceptor I to a receiving member (including an intermediate transfer medium), and may be, for example, a conventional one in a roll form. The receiving member in the invention is not particularly limited if it is a medium capable of receiving a toner image formed on the electrophotographic photoreceptor 1. For example, in cases where a toner image is directly transferred from the electrophotographic photoreceptor 1 to a piece of paper or the like, the piece of paper or the like serves as the receiving medium, and in cases where an intermediate transfer medium is used, the intermediate transfer medium serves as the receiving member.

The development device 6 develops an electrostatic latent image on the electrophotographic photoreceptor 1 into a toner image.

The toner to be used in the development device 6 is further described below. The toner preferably has an average shape factor ($ML2/AX\pi/4\times100$, wherein ML represents the maximum length of the toner particles, and A represents the projected area of the toner particles) of about 100 to about 150, and more preferably about 100 to about 140. Further, the toner preferably has a volume average particle diameter of about 2 μm to about 12 μm, more preferably about 3 μm to about 12 μm, and further preferably about 3 μm to about 9 μm. Through the use of the toner having the average shape factor and volume average particle diameter in the above-described ranges, images with high developability, high transferring property, and high quality of image are produced.

The electrophotographic photoreceptor cleaning device 8 removes residual toner remaining on the electrophotographic photoreceptor 1 after transfer. The electrophotographic photoreceptor cleaning device 8 preferably has a blade member in contact with the electrophotographic photoreceptor 1 at a linear pressure of about 10 to about 150 g/cm. The de-electrifying device 9 eliminates residual electric charges from the electrophotographic photoreceptor 1.

The image forming apparatus shown in FIG. 1 further includes a fixing device 11 which fixes the toner image transferred to the receiving medium.

The electrophotographic process cartridge according to an embodiment of the invention includes an electrophotographic photoreceptor 1, a charging device 2, and at least one selected from the group consisting of an exposure device 5, a development device 6, and a transfer device 7. The electrophotographic process cartridge is removable from the main body of an image forming apparatus, and composes an image forming apparatus together with the main body of the image forming apparatus. The electrophotographic process cartridge according to an embodiment of the invention has the same structure as the image forming apparatus according to an embodiment of the invention, except that the charging device 2 and at least one selected from the group consisting of the exposure device 5, development device 6, and transfer device 7 are housed in a cartridge.

The charging roller according to an embodiment of the invention is preferably prevented from contacting with the below-described electrophotographic photoreceptor 1 until the electrophotographic process cartridge is mounted on an electrophotographic machine. When the process cartridge includes the mechanism for isolating the charging roller, the roller offers excellent storage stability and vibration resistance, and causes no irregularities in electrical properties or occurrence of image quality defects even after long-term storage or under strong vibration stress. The mechanism for isolating the charging roller is preferably provided outside the image effective region of the charging member. For example, in the electrophotographic process cartridge, a wedge-shaped member is disposed on the electrophotographic photoreceptor side of the shaft of the charging roller support for floating the charging member to isolate it from the electrophotographic photoreceptor, and the wedge-shaped member is pulled out immediately before the electrophotographic process cartridge is mounted on an electrophotographic machine.

In the image forming apparatus and electrophotographic process cartridge according to an embodiment of the invention, the electrophotographic photoreceptor 1 is charged with the above-described charging device 2 energized with a voltage, and the applied voltage is preferably a direct current voltage. The direct current voltage is preferably in the range of plus or minus about 50 to about 2000 V, and most preferably in the range of about 100 to about 1500 V according to the intended charged potential of the photoreceptor.

EXAMPLES

The invention is further illustrated on the basis of following examples and comparative examples, but the invention is not limited thereto. (Making of charging roll 1)

-Formation of Elastic Layer A--

100 parts by weight of acrylonitrile butadiene rubber: N230SV (manufactured by JSR Corporation), 60 parts by weight of carbon black: Asahi #60 (manufactured by Asahi Carbon Co., Ltd.), 10 parts by weight of carbon black: Ketjen Black EC (manufactured by Lion Corp.), 20 parts by weight of dioctyl phthalate (manufactured by Dainippon Ink And Chemicals, Inc.), 1 part by weight of sulfur (200 mesh, manufactured by Tsurumi Chemical Industry Co., Ltd.), 1 part by weight of a vulcanization accelerator (NOCCELER DM, manufactured by Ouchi Shinko Chemical Industrial Co Ltd.), and 1 part by weight of a vulcanization accelerator (NOCCELER TT, manufactured by Ouchi Shinko Chemical Industrial Co Ltd.) were mixed, and kneaded with an open roll mill. Thereafter, the mixture was cylindrically applied at a thickness of 3 mm to a support composed of SUM-Ni having a diameter of 8 mm, and the coated support was placed in a cylindrical mold having an inside diameter of 14.5 mm and vulcanized at a temperature of 175° C. for 20 minutes. The coated support was taken out from the mold, and then ground with a grinding wheel to give a diameter of 14.0 mm, a wall thickness of 3.0 mm, and a surface roughness Rz of 5 μm to form a cylindrical elastic layer A.

-Formation of Surface Layer A-

100 parts by weight of to copolymer nylon (AMILAN CM8000, manufactured by Toray Industries, Inc.) was dissolved in 500 parts by weight of methanol while heated, thereafter 250 parts by weight of N-butanol and 50 parts by weight of distilled water were added to the solution, and the mixture was stirred to obtain a resin solution. To the resin solution, 50 parts by weight of antimony-doped tin oxide (S1, manufactured by Mitsubishi Materials Corporation) were added and dispersed therein with a sand grinder mill, and the resulting dispersion liquid was diluted with 100 parts by weight of methanol to obtain a surface layer coating solution A. The surface layer coating solution was applied to the elastic layer A by immersion, and dried by heating at a temperature of 150° C. for 10 minutes to form a surface layer A having a thickness of 5 μm, thus a charging roll 1 was obtained.

The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 1 was cut out with a knife, and the moisture content thereof was measured by the Karl Fischer method. The moisture content was 2.6% by weight after storage for 48 hours in an environment having a temperature of 10° C. and a humidity of 15%, and 5.2% by weight after storage for 48 hours in an environment having a temperature of 28° C. and a humidity of 85%. The volume resistivity of the surface layer at a temperature of 20° C. was $8\times10^{9}$ Ω·cm.

(Making of Charging Roll 2)

-Formation of Elastic Layer B-

100 parts by weight of acrylonitrile butadiene rubber: N230SV (manufactured by JSR Corporation), 50 parts by weight of carbon black: Asahi #60 (manufactured by Asahi Carbon Co., Ltd.), 10 parts by weight of carbon black: Ketjen Black EC (manufactured by Lion Corp.), 30 parts by weight of dioctyl phthalate (manufactured by Dainippon Ink And Chemicals, Inc.), 1 part by weight of sulfur (200 mesh, manufactured by Tsurumi Chemical Industry Co., Ltd.), 1 part by weight of a vulcanization accelerator (NOCCELER DM, manufactured by Ouchi Shinko Chemical Industrial Co Ltd.), and 1 part by weight of a vulcanization accelerator (NOCCELER TT, manufactured by Ouchi Shinko Chemical Industrial Co Ltd.) were mixed, and kneaded with an open roll mill. Thereafter, the mixture was cylindrically applied at a thickness of 3 mm to a support composed of SUM-Ni having a diameter of 8 mm, and the coated support was placed in a cylindrical mold having an inside diameter of 14.5 mm and vulcanized at a temperature of 175° C. for 20 minutes. The coated support was taken out from the mold, and then ground with a grinding wheel to give a diameter of 14.0 mm, a wall thickness of 3.0 mm, and a surface roughness Rz of 5 μm to form a cylindrical elastic layer B.

-Formation of Surface Layer B-

80 parts by weight of a blocked isocyanate (SUMIDUR 3175, manufactured by Sumitomo Bayer Urethane Co., Ltd.) was dissolved in 500 parts by weight of methyl ethyl ketone, thereafter 0.005 parts by weight of dioctyltin dilaurate as a catalyst were added, and dissolved to obtain a surface layer coating solution B. The surface layer coating solution B was applied to the elastic layer B by immersion, and dried by heating at a temperature of 150° C. for 10 minutes to form a surface layer B having a thickness of 2.5 μm, thus a charging roll 2 was obtained.

The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 2 was cut out with a knife, and the moisture content thereof was measured by the Karl Fischer method. The moisture content was 2.8% by weight after storage for 48 hours in an environment having a temperature of 10° C. and a humidity of 15%, and 4.4% by weight after storage for 48 hours in an environment having a temperature of 28° C. and a humidity of 85%. The volume resistivity of the surface layer at a temperature of 20° C. was $5\times10^{10}$ Ω·cm.

(Making of Charging Roll 3)

-Formation of Elastic Layer C-

An elastic layer C was formed in the same manner as the elastic layer B of the charging roll 2.

-Formation of Surface Layer C-

80 parts by weight of a blocked isocyanate (SUMIDUR 3175, manufactured by Sumitomo Bayer Urethane Co., Ltd.) was dissolved in 500 parts by weight of methyl ethyl ketone, thereafter 20 parts by weight of a fluorine modified acrylic resin (MODIPER F200, manufactured by Nof Corporation) and 0.005 parts by weight of dioctyltin dilaurate as a catalyst were added, and dissolved to obtain a resin solution. To the resulting resin solution, 50 parts by weight of antimony-doped tin oxide (S1, manufactured by Mitsubishi Materials Corporation) were added and dispersed with a sand grinder mill, and the dispersion liquid was diluted with 100 parts by weight of MEK to obtain a surface layer coating solution C. The surface layer coating solution C was applied to the elastic layer C by immersion, and dried by heating at a temperature of 150° C. for 10 minutes to form a surface layer C having a thickness of 5 μm, thus a charging roll 3 was obtained.

The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 3 was cut out with a knife, and the moisture content thereof was measured by the Karl Fischer method. The moisture content was 2.7% by weight after storage for 48 hours in an environment having a temperature of 10° C. and a humidity of 15%, and 5.9% by weight after storage for 48 hours in an environment having a temperature of 28° C. and a humidity of 85%. The volume resistivity of the surface layer at a temperature of 20° C. was $2\times10^{10}$ Ω·cm.

-Formation of Elastic Layer D-

An elastic layer D was formed in the same manner as the elastic layer A of the charging roll 1.

-Formation of Surface Layer D-

The surface layer coating solution A prepared for the charging roll 1 was applied to the elastic layer D by immersion, and dried at a temperature of 150° C. for 10 minutes to form a surface layer D having a thickness of 9 μm, thus a charging roll 4 was obtained. The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 4 was cut out with a knife, and the moisture content thereof was measured by the Karl Fischer method. The moisture content was 3.0% by weight after storage for 48 hours in an environment having a temperature of 10° C. and a humidity of 15%, and 7.2% by weight after storage for 48 hours in an environment having a temperature of 28° C. and a humidity of 85%. The volume resistivity of the surface layer at a temperature of 20° C. was $1\times10^{10}$ Ω·cm.

(Making of Charging Roll 5)

-Formation of Elastic Layer E-

An elastic layer E was formed in the same manner as the elastic layer A of the charging roll 1.

-Formation of Surface Layer E-

100 parts by weight of alkyl acetalized polyvinyl alcohol (S-Lec KX-1) was dissolved in a mixture of 200 parts by weight of isopropyl alcohol and 300 parts by weight of water to obtain a resin solution. To the resulting resin solution, 50 parts by weight of antimony-doped tin oxide (S1, manufactured by Mitsubishi Materials Corporation) were added and dispersed with a sand grinder mill, and the dispersion liquid was diluted with 100 parts by weight of methanol to obtain a surface layer coating solution E. The surface layer coating solution was applied to the elastic layer E by immersion, and dried by heating at a temperature of 150° C. for 10 minutes to form a surface layer E having a thickness of 5 μm, thus a charging roll 5 was obtained.

The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 5 was cut out with a knife, and the moisture content thereof was measured by the Karl Fischer method. The moisture content was 8% by weight after storage for 48 hours in an environment having a temperature of 10° C. and a humidity of 15%, and 10% by weight after storage for 48 hours in an environment having a temperature of 28° C. and a humidity of 85%. The volume resistivity of the surface layer at a temperature of 20° C. was $4\times10^5$ Ω·cm.

(Making of Charging Roll 6)

-Formation of Elastic Layer F-

An elastic layer E was formed in the same manner as the elastic layer A of the charging roll 1, except that no grinding with a grinding wheel was performed.

-Formation of Surface Layer F-

An surface layer F having a thickness of 5 μm was formed in the same manner as the surface layer A of the charging roll 1, thus a charging roll 6 was obtained.

The thickness of the surface layer was measured as follows: the charging roll was cut out with a knife to give a cross-section, and the thickness of the surface layer in the areas on the projections of the elastic layer was measured with a laser microscope. Further, a portion containing the elastic layer and surface layer of the charging roll 6 was cut out with a knife, and the moisture content thereof was measured by the Karl Fischer method. The moisture content was 2.6% by weight after storage for 48 hours in an environment having a temperature of 10° C. and a humidity of 15%, and 5.2% by weight after storage for 48 hours in an environment having a temperature of 28° C. and a humidity of 85%. The volume resistivity of the surface layer at a temperature of 20° C. was $8\times10^9$ Ω·cm.

(Charging Device Cleaning Roll)

A hot melt adhesive (BR4301, manufactured by Nisshin Chemical Co., Ltd.) was applied onto a cylindrical core material composed of SUS416 having a diameter of 6 mm. A sheet of polyether polyol foamed urethane sponge (EP70, manufactured by Inoac Corporation) was hollowed with a penetrating drill, through which the cylindrical core material coated with the hot melt adhesive was drawn, thereafter they were fusion bonded in an oven at a temperature of 90° C. Subsequently, the periphery of the bonded urethane sponge was ground with a grinding machine to give a diameter of 12 mm and a wall thickness of 3 mm, thus a charging device cleaning roll (cleaning member) was obtained.

(Making of Electrophotographic Photoreceptor)

100 parts by weight of zinc oxide (average particle diameter: 70 nm, manufactured by Tayca Corporation, specific surface area value: 15 m2/g) were stirred together with 500 parts by weight of tetrahydrofuran, to the mixture 1.25 parts by weight of a silane coupling agent (KBM603, manufactured by Shin-Etsu Chemical Co., Ltd.) was added, and stirred for 2 hours. Thereafter, tetrahydrofuran was removed by distillation under reduced pressure, and the mixture was baked at a temperature of 120° C. for 3 hours to obtain zinc oxide fine particles surface-treated with the silane coupling agent.

38 parts by weight of a solution composed of 60 parts by weight of the zinc oxide fine particles surface-treated with the silane coupling agent, 0.6 parts by weight of alizarin, 13.5 parts by weight of a blocked isocyanate (SUMIDUR 3175, manufactured by Sumitomo Bayer Urethane Co., Ltd.) as the curing agent, and 15 parts by weight of a butyral resin (BM-1, manufactured by Sekisui Chemical Co., Ltd.) dissolved in 85 parts by weight of methyl ethyl ketone were mixed with 25 parts by weight of methyl ethyl ketone, and the mixture was dispersed for 4 hours with a sand mill containing glass beads having a diameter of 1 mm, thus a dispersion liquid was obtained.

To the resulting dispersion liquid 0.005 parts by weight of dioctyltin dilaurate as the catalyst, and 4.0 parts by weight of silicone resin particles (TOSPAL 145, manufactured by GE Toshiba Silicone Co., Ltd.) were added, thus an undercoat layer coating solution was obtained. The coating solution was applied by immersion to a mirror-finished aluminum substrate having a diameter of 30 mm, a length of 340 mm, and a wall thickness of 1 mm, and cured by drying at a temperature of 180° C. for 40 minutes to form an undercoat layer having a thickness of 25 μm.

Subsequently, a mixture composed of 15 parts by weight of hydroxygallium phthalocyanine, which has diffraction peaks at least at Bragg angles (2θ±0.2°) of 7.3°, 16.0°, 24.9°, and 28.0° CuK= characteristic X-ray diffractometry, as the charge generating substance, 10 parts by weight of a vinyl chloride-vinyl acetate copolymer resin (VMCH, manufactured by Nippon Unicar Co., Ltd.) as the binding resin, and 200 parts by weight of N-butyl acetate was dispersed for 4 hours with a sand mill containing glass beads having a diameter of 1 mm.

To the resulting dispersion liquid 175 parts by weight of N-butyl acetate and 180 parts by weight of methyl ethyl ketone were added and stirred, thus a charge-generating layer coating solution was obtained. The charge-generating layer coating solution was applied to the undercoat layer by immersion, and dried at a normal temperature to form a charge-generating layer having a thickness of 0.2 μm.

Subsequently, 1 part by weight of tetrafluoride ethylene resine particles (average particle diameter: 0.2 μm), 0.02 parts by weight of a fluorine-based graft polymer, and 5 parts by weight of tetrahydrofuran were thoroughly stirred together with 2 parts by weight of toluene, thus a suspension of tetrafluoride ethylene resin particles was obtained. Subsequently, 4 parts by weight of N,N'-diphenyl-N,N'-bis(3-methyl phenyl)-[1,1']biphenyl-4,4'-diamine as the charge transporting substance, 6 parts by weight of a bisphenol Z type polycarbonate resin (viscosity average molecular weight: 40,000), 23 parts by weight of tetrahydrofuran, and 10 parts by weight of toluene were mixed and dissolved. To the solution, the suspension of tetrafluoride ethylene resin particles prepared above was added and mixed by stirring, and then the mixture was dispersed six times at elevated pressure up to 400 kgf/cm$^2$ using a high-pressure homogenizer (trade name: LA-33S, manufactured by Nanomizer Co., Ltd.) equipped with a flow-through chamber having a fine flow channel. To the dispersion 0.2 parts by weight of 2,6-di-t-butyl-4-methylphenol were mixed, thus a coating solution for forming the charge transport layer was obtained. The coating solution was applied to the charge-generating layer and dried at a temperature of 115° C. for 40 minutes to form a charge transport layer having a film thickness of 30 μm, thus the intended electrophotographic photoreceptor was obtained.

Example 1

The charging roll 1, charging device cleaning roll, and electrophotographic photoreceptor were mounted on a modified process cartridge for a full color printer (Docu Centre Color f450, manufactured by Fuji Xerox Co., Ltd.), and the process cartridge was mounted on a modified version of a full color printer (Docu Centre Color f450, manufactured by Fuji Xerox Co., Ltd.). A direct current of −40 μA was applied to the charging roll in an environment having high temperature and high humidity (28° C./85%), and printing was performed on 30,000 sheets. After storage for one week, a direct current of −40 μA was applied again to the charging roll in an environment having high temperature and high humidity (28° C./85%), and a half tone image was printed on the full sheet, and image quality evaluation (density irregularity, presence or absence of white streaks and/or color streaks). The results are listed in Table 1. The modified version of Docu Centre Color f450 (manufactured by Fuji Xerox Co., Ltd.) equipped with the process cartridge included an electrophotographic photoreceptor, a charging unit, an electrostatic latent image forming unit, a development unit, and a transfer unit.

Comparative Example 1

A process cartridge was made in the same manner as Example 1, except that the film thickness of the surface layer of the charging roll 1 used in Example 1 was changed to 1 μm, and subjected to evaluations. The results are listed in Table 1. Further, a portion containing the elastic layer and surface layer of the charging roll used in Comparative Example 1 was cut out with a knife, and the moisture content thereof was measured by the Karl Fischer method. The moisture content was 1.5% by weight after storage for 48 hours in an environment having a temperature of 10° C. and a humidity of 15%, and 4.2% by weight after storage for 48 hours in an environment having a temperature of 28° C. and a humidity of 85%.

Example 2

A process cartridge was made in the same manner as Example 1, except that the charging roll 2 was used in place of the charging roll 1. The results are listed in Table 1.

Comparative Example 2

A process cartridge was made in the same manner as Example 1, except that the film thickness of the surface layer of the charging roll 2 used in Example 2 was changed to 1.5 μm, and subjected to evaluations. The results are listed in Table 1. Further, a portion containing the elastic layer and surface layer of the charging roll used in Comparative Example 2 was cut out with a knife, and the moisture content thereof was measured by the Karl Fischer method. The moisture content was 0.9% by weight after storage for 48 hours in an environment having a temperature of 10° C. and a humidity of 15%, and 1.9% by weight after storage for 48 hours in an environment having a temperature of 28° C. and a humidity of 85%.

Example 3

A process cartridge was made in the same manner as Example 1, except that the charging roll 3 was used in place of the charging roll 1. The results are listed in Table 1.

Comparative Example 3

A process cartridge was made in the same manner as Example 1, except that the film thickness of the surface layer of the charging roll 3 used in Example 3 was changed to 0.5 μm, and subjected to evaluations. The results are listed in Table 1. Further, a portion containing the elastic layer and surface layer of the charging roll used in Comparative Example 3 was cut out with a knife, and the moisture content thereof was measured by the Karl Fischer method. The moisture content was 0.3% by weight after storage for 48 hours in an environment having a temperature of 10° C. and a humidity of 15%, and 1.3% by weight after storage for 48 hours in an environment having a temperature of 28° C. and a humidity of 85%.

Example 4

A process cartridge was made in the same manner as Example 1, except that the charging roll 4 was used in place of the charging roll 1. The results are listed in Table 1.

Comparative Example 4

A process cartridge was made in the same manner as Example 1, except that the film thickness of the surface layer of the charging roll 4 used in Example 4 was changed to 12 μm, and subjected to evaluations. The results are listed in Table 1. Further, a portion containing the elastic layer and surface layer of the charging roll used in Comparative Example 3 was cut out with a knife, and the moisture content thereof was measured by the Karl Fischer method. The moisture content was 3.5% by weight after storage for 48 hours in an environment having a temperature of 10° C. and a humidity of 15%, and 8.6% by weight after storage for 48 hours in an environment having a temperature of 28° C. and a humidity of 85%.

Comparative Example 5

A process cartridge was made in the same manner as Example 1, except that the charging roll 5 was used in place of the charging roll 1. The results are listed in Table 1.

Comparative Example 6

A process cartridge was made in the same manner as Example 1, except that the charging roll 6 was used in place of the charging roll 1. The results are listed in Table 1.

TABLE 1

| | Image quality evaluation after printing on 30,000 sheets | | | Image quality evaluation after storage for 1 week | | |
|---|---|---|---|---|---|---|
| | Density irregularity | White streaks | Color streaks | Density irregularity | White streaks | Color streaks |
| Example 1 | Absent | Absent | Absent | Absent | Absent | Absent |
| Example 2 | Absent | Absent | Absent | Absent | Absent | Absent |
| Example 3 | Absent | Absent | Absent | Absent | Absent | Absent |
| Comparative example 1 | Present | Slightly present | Absent | Present | Present | Present |
| Comparative example 2 | Present | Present | Present | Present | Present | Present |

TABLE 1-continued

| | Image quality evaluation after printing on 30,000 sheets | | | Image quality evaluation after storage for 1 week | | |
|---|---|---|---|---|---|---|
| | Density irregularity | White streaks | Color streaks | Density irregularity | White streaks | Color streaks |
| Comparative example 3 | Present | Slightly present | Slightly present | Present | Present | Present |
| Example 4 | Absent | Absent | Absent | Absent | Absent | Absent |
| Comparative example 4 | Present | Slightly present | Absent | Present | Present | Present |
| Comparative example 5 | Present | Present | Present | Evaluation impossible because of exfoliation of surface layer | | |
| Comparative example 6 | Present | Present | Present | Evaluation impossible because of exfoliation of surface layer | | |

The results listed in Table 1 indicate that favorable charging was achieved and favorable images were produced in Examples 1 to 4.

According to embodiments of the invention, there are provided:

<1> a charging roller including:

a support;

an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

<2>. The charging roller of <1>, wherein the surface layer comprises one or more resins selected from the group consisting of halogenated resins, polyamide resins, and polyurethane resins.

<3> The charging roller of <1>, wherein the surface layer has a volume resistivity of about $10^3$ to about $10^{12}$ Ω·cm at a temperature of 20° C.

<4>. An electrophotographic process cartridge including:

an electrophotographic photoreceptor;

a charging unit which is disposed in contact with the electrophotographic photoreceptor and charges the electrophotographic photoreceptor to a predetermined electric potential; and at least one selected from the group consisting of an electrostatic latent image forming unit that forms an electrostatic latent image on the charged surface of the electrophotographic photoreceptor, a development unit which transfers toner to the electrostatic latent image formed on the electrophotographic photoreceptor to develop the image into a toner image, and a transfer unit which transfers the toner image to a receiving member;

the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

<5>. The electrophotographic process cartridge of <4>, wherein a direct current is applied alone to the charging roller for charging the electrophotographic photoreceptor.

<6>. The electrophotographic process cartridge of <4>, wherein the electrophotographic photoreceptor and the charging roller do not contact each other until the cartridge is mounted on an electrophotographic machine.

<7> The electrophotographic process cartridge of <4>, wherein the surface layer has a volume resistivity of about $10^3$ to about $10^{12}$ Ω·cm at a temperature of 20° C.

<8>. The electrophotographic process cartridge of <4> including a cleaning member that is disposed in contact with the charging roller and cleans the surface of the charging roller.

<9>. The electrophotographic process cartridge of <4>, wherein the surface layer contains one or more resins selected from the group consisting of halogenated resins, polyamide resins, and polyurethane resins.

<10>. The electrophotographic process cartridge of <8>, wherein the cleaning member comprises a core material and an elastic layer comprising a porous foam or cloth.

<11>. The electrophotographic process cartridge of <9> including a cleaning member that is disposed in contact with the charging roller and cleans the surface of the charging roller.

<12>. The electrophotographic process cartridge of <10>, wherein the porous foam is composed of at least one material selected from the group consisting of urethane resins, melamine resins, acrylic resins, cellulose resins, polyamide resins, polyethylene resins, polyester resins, polypropylene resins, polystyrene resins, polyvinyl chloride resins, vinyl acetate resins, and silicone resins.

<13>. The electrophotographic process cartridge of <11>, wherein the cleaning member comprises a core material and an elastic layer comprising a porous foam or cloth.

<14>. The electrophotographic process cartridge of <11>, wherein the electrophotographic photoreceptor and the charging roller do not contact each other until the cartridge is mounted on an electrophotographic machine.

<15>. The electrophotographic process cartridge of <12>, wherein the electrophotographic photoreceptor and the charging roller do not contact each other until the cartridge is mounted on an electrophotographic machine.

<16>. An image forming apparatus including:

an electrophotographic photoreceptor;

a charging unit that is disposed in contact with the electrophotographic photoreceptor and charges the electrophotographic photoreceptor to a predetermined electric potential;

an electrostatic latent image forming unit that forms an electrostatic latent image on the charged surface of the electrophotographic photoreceptor;

a development unit that transfers toner to the electrostatic latent image formed on the electrophotographic photoreceptor to develop the image into a toner image; and a transfer unit that transfers the toner image to a receiving member, the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

<17>. The image forming apparatus of <16>, wherein a direct current is applied alone to the charging roller for charging the electrophotographic photoreceptor.

<18> The image forming apparatus of <16>, wherein the surface layer has a volume resistivity of about $10^3$ to about $10^{12}$ Ω·cm at a temperature of 20° C.

<19>. The image forming apparatus of <16> including a cleaning member that is disposed in contact with the charging roller and cleans the surface of the charging roller.

<20>. The image forming apparatus of <16>, wherein the surface layer contains one or more resins selected from the group consisting of halogenated resins, polyamide resins, and polyurethane resins.

<21>. The image forming apparatus of <19>, wherein the cleaning member comprises a core material and an elastic layer including a porous foam or cloth.

<22>. The image forming apparatus of <21>, wherein the porous foam is composed of at least one material selected from the group consisting of urethane resins, melamine resins, acrylic resins, cellulose resins, polyamide resins, polyethylene resins, polyester resins, polypropylene resins, polystyrene resins, polyvinyl chloride resins, vinyl acetate resins, and silicone resins.

<23>. The electrophotographic process cartridge of <21>, wherein the electrophotographic photoreceptor and the charging roller do not contact each other until the cartridge is mounted on an electrophotographic machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in the order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging roller comprising:

a support;

an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

2. The charging roller of claim 1, wherein the surface layer comprises one or more resins selected from the group consisting of halogenated resins, polyamide resins, and polyurethane resins.

3. An electrophotographic process cartridge comprising:

an electrophotographic photoreceptor;

a charging unit which is disposed in contact with the electrophotographic photoreceptor and charges the electrophotographic photoreceptor to a predetermined electric potential; and at least one selected from the group consisting of an electrostatic latent image forming unit that forms an electrostatic latent image on the charged surface of the electrophotographic photoreceptor, a development unit which transfers toner to the electrostatic latent image formed on the electrophotographic photoreceptor to develop the image into a toner image, and a transfer unit which transfers the toner image to a receiving member;

the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

4. The electrophotographic process cartridge of claim 3, wherein a direct current is applied alone to the charging roller for charging the electrophotographic photoreceptor.

5. The electrophotographic process cartridge of claim 3, wherein the electrophotographic photoreceptor and the charging roller do not contact each other until the cartridge is mounted on an electrophotographic machine.

6. The electrophotographic process cartridge of claim 3 comprising a cleaning member that is disposed in contact with the charging roller and cleans the surface of the charging roller.

7. The electrophotographic process cartridge of claim 3, wherein the surface layer contains one or more resins selected from the group consisting of halogenated resins, polyamide resins, and polyurethane resins.

8. The electrophotographic process cartridge of claim 6, wherein the cleaning member comprises a core material and an elastic layer comprising a porous foam or cloth.

9. The electrophotographic process cartridge of claim 7 comprising a cleaning member that is disposed in contact with the charging roller and cleans the surface of the charging roller.

10. The electrophotographic process cartridge of claim 8, wherein the porous foam is composed of at least one material selected from the group consisting of urethane resins, melamine resins, acrylic resins, cellulose resins, polyamide resins, polyethylene resins, polyester resins, polypropylene resins, polystyrene resins, polyvinyl chloride resins, vinyl acetate resins, and silicone resins.

11. The electrophotographic process cartridge of claim 9, wherein the cleaning member comprises a core material and an elastic layer comprising a porous foam or cloth.

12. The electrophotographic process cartridge of claim 9, wherein the electrophotographic photoreceptor and the charging roller do not contact each other until the cartridge is mounted on an electrophotographic machine.

13. The electrophotographic process cartridge of claim 10, wherein the electrophotographic photoreceptor and the charging roller do not contact each other until the cartridge is mounted on an electrophotographic machine.

14. An image forming apparatus comprising:

an electrophotographic photoreceptor;

a charging unit that is disposed in contact with the electrophotographic photoreceptor and charges the electrophotographic photoreceptor to a predetermined electric potential;

an electrostatic latent image forming unit that forms an electrostatic latent image on the charged surface of the electrophotographic photoreceptor;

a development unit that transfers toner to the electrostatic latent image formed on the electrophotographic photoreceptor to develop the image into a toner image; and a transfer unit that transfers the toner image to a receiving member, the charging unit comprising: a support; an elastic layer that is provided on the outer peripheral surface of the support, the elastic layer having a ground-finished outer peripheral surface; and a surface layer that is formed to cover the outer peripheral surface of the elastic layer and that has a thickness of about 2 μm to about 10 μm from the outer peripheral surface of the elastic layer, and a proportion of water absorbed in the total of the elastic layer and the surface layer, after storage for 48 hours in an environment having a temperature of 10° C. and a humidity of 15% RH, being about 2% to about 8% by weight, and a proportion of water absorbed in the total of the elastic layer and the surface layer, after storage for 48 hours in an environment having a temperature of 28° C. and a humidity of 85% RH, being about 2% to about 8% by weight.

15. The image forming apparatus of claim 14, wherein a direct current is applied alone to the charging roller for charging the electrophotographic photoreceptor.

16. The image forming apparatus of claim 14 comprising a cleaning member that is disposed in contact with the charging roller and cleans the surface of the charging roller.

17. The image forming apparatus of claim 14, wherein the surface layer contains one or more resins selected from the group consisting of halogenated resins, polyamide resins, and polyurethane resins.

18. The image forming apparatus of claim 16, wherein the cleaning member comprises a core material and an elastic layer comprising a porous foam or cloth.

19. The image forming apparatus of claim 18,wherein the porous foam is composed of at least one material selected from the group consisting of urethane resins, melamine resins, acrylic resins, cellulose resins, polyamide resins, polyethylene resins, polyester resins, polypropylene resins, polystyrene resins, polyvinyl chloride resins, vinyl acetate resins, and silicone resins.

20. The image forming apparatus of claim 18, wherein the electrophotographic photoreceptor and the charging roller do not contact each other until the cartridge is mounted on an electrophotographic machine.

* * * * *